US008136180B2

(12) United States Patent
Leng

(10) Patent No.: US 8,136,180 B2
(45) Date of Patent: Mar. 20, 2012

(54) REMOVABLE GUARDRAIL FRAMEWORK

(75) Inventor: Luhao Leng, Fujlan (CN)

(73) Assignee: New-Tec Integration (Xiamen) Co., Ltd., Xiamen (CN)

( * ) Notice: Subject to any disclaimer, the term of this patent is extended or adjusted under 35 U.S.C. 154(b) by 57 days.

(21) Appl. No.: 12/666,571

(22) PCT Filed: Sep. 23, 2008

(86) PCT No.: PCT/CN2008/072472

§ 371 (c)(1),
(2), (4) Date: Dec. 23, 2009

(87) PCT Pub. No.: WO2009/039792

PCT Pub. Date: Apr. 2, 2009

(65) Prior Publication Data

US 2010/0180379 A1 Jul. 22, 2010

(30) Foreign Application Priority Data

Sep. 24, 2007 (CN) ..... 2007 2 0008343 U

(51) Int. Cl.
*A47C 19/28* (2006.01)
*A47C 21/08* (2006.01)

(52) U.S. Cl. ..... 5/9.1; 5/425; 5/282.1

(58) Field of Classification Search ..... 5/9.1, 425, 5/428, 282.1, 285, 286, 2.1; 403/329, 397, 403/DIG. 14; 256/65.09, 65.12, 65.13
See application file for complete search history.

(56) References Cited

U.S. PATENT DOCUMENTS

| | | | | | |
|---|---|---|---|---|---|
| 898,875 | A | * | 9/1908 | Goldsmith | 5/428 |
| 921,869 | A | * | 5/1909 | Munn | 5/428 |
| 2,647,267 | A | * | 8/1953 | McLaughlin | 5/9.1 |
| 4,063,836 | A | * | 12/1977 | Militano | 403/263 |
| 5,695,175 | A | | 12/1997 | Hawkins | |
| 5,882,001 | A | * | 3/1999 | Reinbold | 256/22 |
| 6,305,671 | B1 | * | 10/2001 | Valentine | 256/65.13 |
| 7,025,335 | B2 | * | 4/2006 | Zhu | 256/22 |
| 7,832,031 | B1 | * | 11/2010 | Lupo | 5/9.1 |

FOREIGN PATENT DOCUMENTS

| | | | |
|---|---|---|---|
| CN | 2588869 | Y | 12/2003 |
| CN | 2824722 | Y | 10/2006 |
| CN | 201108215 | Y | 9/2008 |
| FR | 2590612 | A1 | 5/1987 |
| GB | 2285830 | A | 7/1995 |

* cited by examiner

*Primary Examiner* — Michael Trettel
(74) *Attorney, Agent, or Firm* — Rabin & Berdo, P.C.

(57) ABSTRACT

The invention discloses a removable guardrail structure. The guardrail is connected between the two upright posts of a bunk bed and provided with two ends, which are respectively detachably connected with the two upright posts.

2 Claims, 18 Drawing Sheets

B

REMOVABLE GUARDRAIL FRAMEWORK

FIELD OF THE INVENTION

The present invention relates to removable guardrail framework for a bunk bed.

BACKGROUND OF THE INVENTION

The upper and lower layer bed especially the upper layer bed of the bunk bed must have guardrail for preventing an individual from falling out of the bed. Traditional guardrails are fixed between the two upright poles which are the upper portion of the legs beyond the upper layer bed of the bunk bed, or the fixing upright poles fixed in the edge of the upper layer bed. Because the guardrail and the upright poles are unremovable, thus the occupied room can not be changed according to requirements such as in transporting, carrying, storing, and the transporting, carrying, storing are very inconvenient.

SUMMARY OF THE INVENTION

The object of the present invention is to provide a removable guardrail framework which obviated the disadvantages of the guardrail framework of the prior art.

This and other objects of the present invention are achieved by providing a removable guardrail framework, the guardrail is connected between the two upright posts of a bunk bed and provided with two ends, which are respectively detachably connected with the two upright posts.

In a preferred embodiment of the present invention, the removable guardrail framework further comprising a fitting member provided with a plurality of clamps respectively clamped to a plurality of guardrails distributed up and down.

In a preferred embodiment of the present invention, said upright post is provided with plastic sleeves; the ends of said guardrails are detachably inserted into the inner holes of said sleeves.

In a preferred embodiment of the present invention, said upright pole comprises a rod and a plurality of position collars sleeved on said rod, each of said position collar is provided with a sleeve.

In a preferred embodiment of the present invention, said upright pole is a hollow pipe, and said hollow pipe is provided with connecting holes through the pipe wall, and each said connecting holes is provided with a plastic receiving sleeve; the end of said guardrail is detachably inserted in the inner hole of said sleeve.

In a preferred embodiment of the present invention, the bottom of each said sleeve is provided with a flexible arm protruded backwardly, said flexible arm is provided with a protrusion; the bottom of the end portion of said guardrail is provided with a groove, the end portion of said guardrail is detachably inserted into the inner hole of said sleeve, and said protrusion is inserted in said groove.

In a preferred embodiment of the present invention, said upright pole is a hollow pipe, said hollow pipe is provided with connecting holes through the pipe wall, the end portion of said guardrail is provided with a plastic sleeve; and said plastic sleeve is detachably inserted in the connecting hole of said pipe.

In a preferred embodiment of the present invention, said sleeve is provided with a flexible arm, said flexible arm is provided with two protrusions, one protrusion positioned in the outside is a clamping pole, the other protrusion positioned in the innerside is a button pole, said clamping pole and button pole formed a clamping groove adapted to the thickness of the wall of upright pole; said sleeve is inserted in said connecting hole and said clamping pole is disposed inside the upright pole, said clamping groove is sleeved in the edge of said connecting hole.

In a preferred embodiment of the present invention, said upright pole is provided with a clamping member, said clamping member comprising a clamping groove and an opening disposed in said clamping groove which is connected with said clamping groove; the end portion of said guardrail is inserted into said clamping groove from said opening.

In a preferred embodiment of the present invention, said upright pole comprising a rod and supporting piece fixed on said rod, said supporting piece having a clamping member.

In a preferred embodiment of the present invention, said upright pole is hollow pipe, said hollow pipe is provided with connecting holes through in the wall, each said connecting hole is provided with a plastic sleeve; the end portion of said guardrail is extended traverse to form a clamping portion, said clamping portion is detachably inserted in said sleeve.

In a preferred embodiment of the present invention, said upright pole is hollow pipe, said hollow pipe is provided with connecting holes through in the wall, and the pipe further equipped with a plastic sleeve, said sleeve is provided with two protrusion ring, a clamping groove is formed between said two protrusion rings, said sleeve is disposed in said connecting hole, and said clamping groove is inserted in the edge of said connecting hole; the end portion of said guardrail is inserted in said inner hole of said sleeve.

Advantages: because the end portions of the guardrail are detachably connected to the upright poles, thus they can be changed according to situation, for example, they can be disassembled in transporting, carrying and storing and assembled in use, thus facilitate the transporting, carrying and storage for the user. Because the parts detachably clamped to a plurality of guardrails, thus these guardrails can be positioned securely. Because the end portions of the guardrail are detachably inserted into the inner holes of the plastic sleeves, thus the assembly between the end portions of guardrail and plastic sleeves are stable, silence and convenient. Because a plurality of position collars are sleeved on the rod, and each position collar is protruded out a receiving sleeve, thus locating the position collar will locating the position of the guardrail. Because the protrusion of the flexible arm is inserted into the clamping groove of the end portion of said guardrail, thus the axis direction and radial direction of the end portion of the guard will be positioned, and the end portion of the guard will be fixed securely. Because the clamping groove of the flexible arm of said sleeve sleeved on the edge of the upright poles, the axis direction and radial direction of the end portion of the guard will be positioned, and the end portion of the guard will be fixed securely, and the button pressed by the button will drive the flexible arm to make the clamping pole to detach from the upright pole, thus facilitate to disassemble the upright pole and the end portion of the guardrail. Because the end portions of the guardrails are inserted into the clamping groove from the opening, thus the end portion of the guardrail will be clamped securely in the clamping groove by the gravity. The end portions of the guardrails are extended transverse to form clamping portions, and the clamping portions are detachably inserted in the sleeves, thus the connection is secure. The clamping groove formed between the two protrusion ring, the clamping groove connecting the edge of the connecting hole, thus the connection between the sleeve and the upright pole is secure.

BRIEF DESCRIPTION OF THE INVENTION

Preferred embodiments of the present invention will be described with reference to the accompanying drawings.

DETAILED DESCRIPTION OF THE PREFERRED EMBODIMENTS

Embodiment 1

Figure 1:
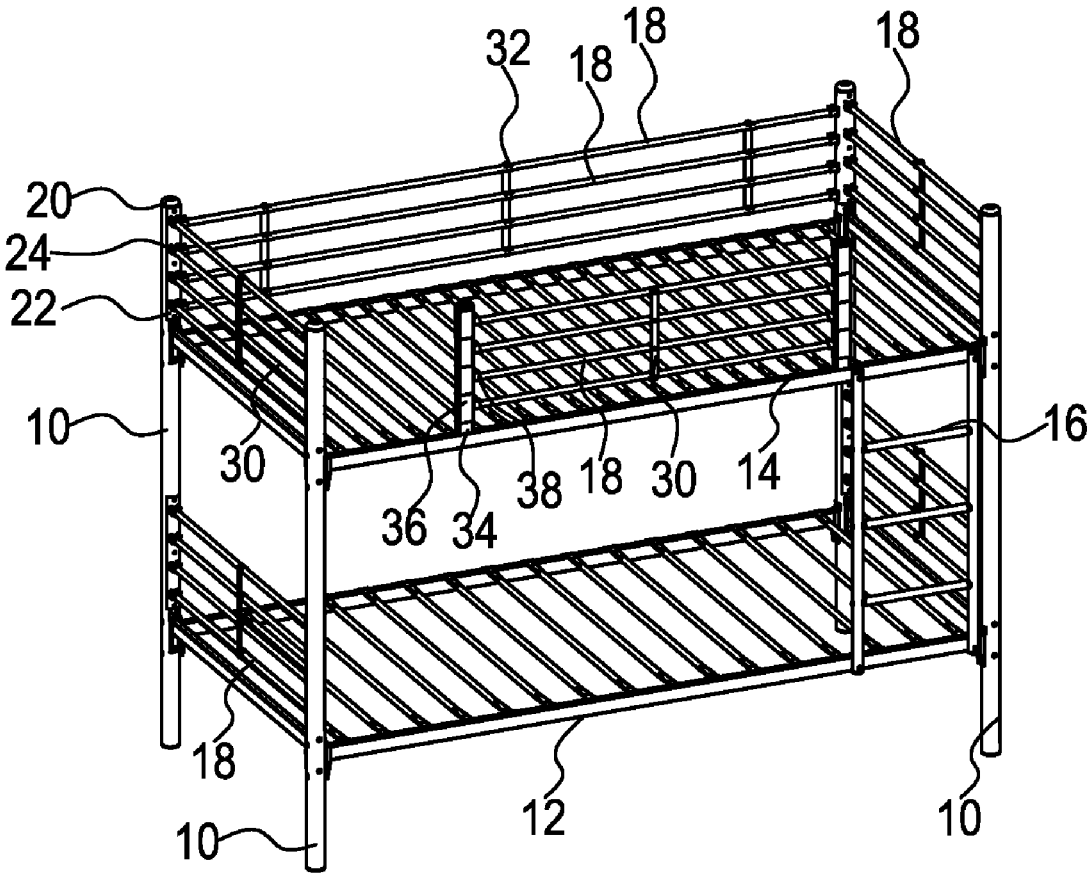
FIG. 1 is a perspective view of the bunk bed of the present invention according to embodiment 1.
Figure 2:
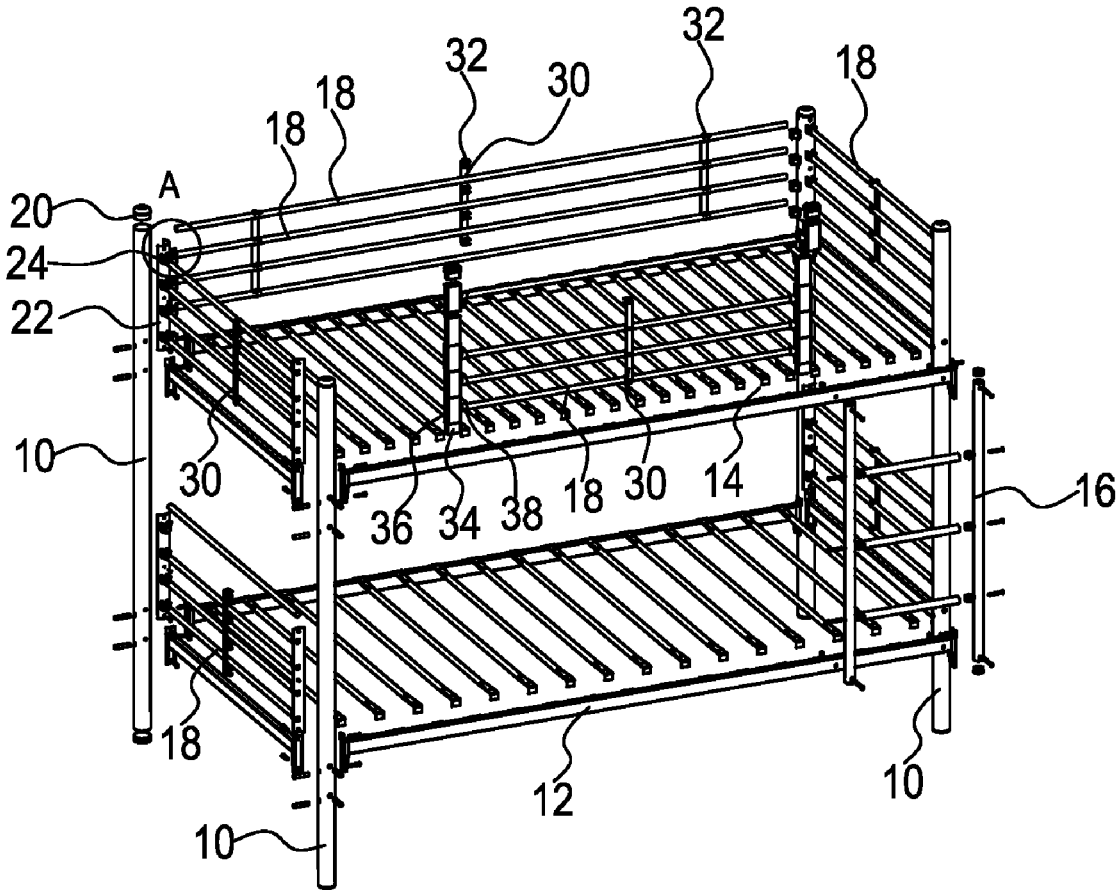
FIG. 2 is an exploded perspective view of the bunk bed of the present invention according to embodiment 1.

Referring to FIG. 1 and FIG. 2 which shows the perspective view and exploded perspective view of the bunk bed in embodiment 1 respectively. The bunk bed comprises four legs 10, a lower bed 12, an upper bed 14, a ladder 16 and several guardrails 18.

The lower bed 12 is detachably disposed between the lower portions of the four legs 10, the upper bed 14 is detachably disposed between the upper portions of the four legs 10, the ladder 16 is detachably connected between the front sides of the lower bed 12 and upper bed 14. According to requirement, the legs 10 are hollow pipe, and the upper end of each pipe provided with a plug 20. Each leg 10 has an extending portion beyond the upper bed 14, several guardrails 18 are parallel disposed up and down between the front extending portion and the rear extending portion, and other several guardrails 18 are parallel disposed between the two rear extending portions.

Figure 3:
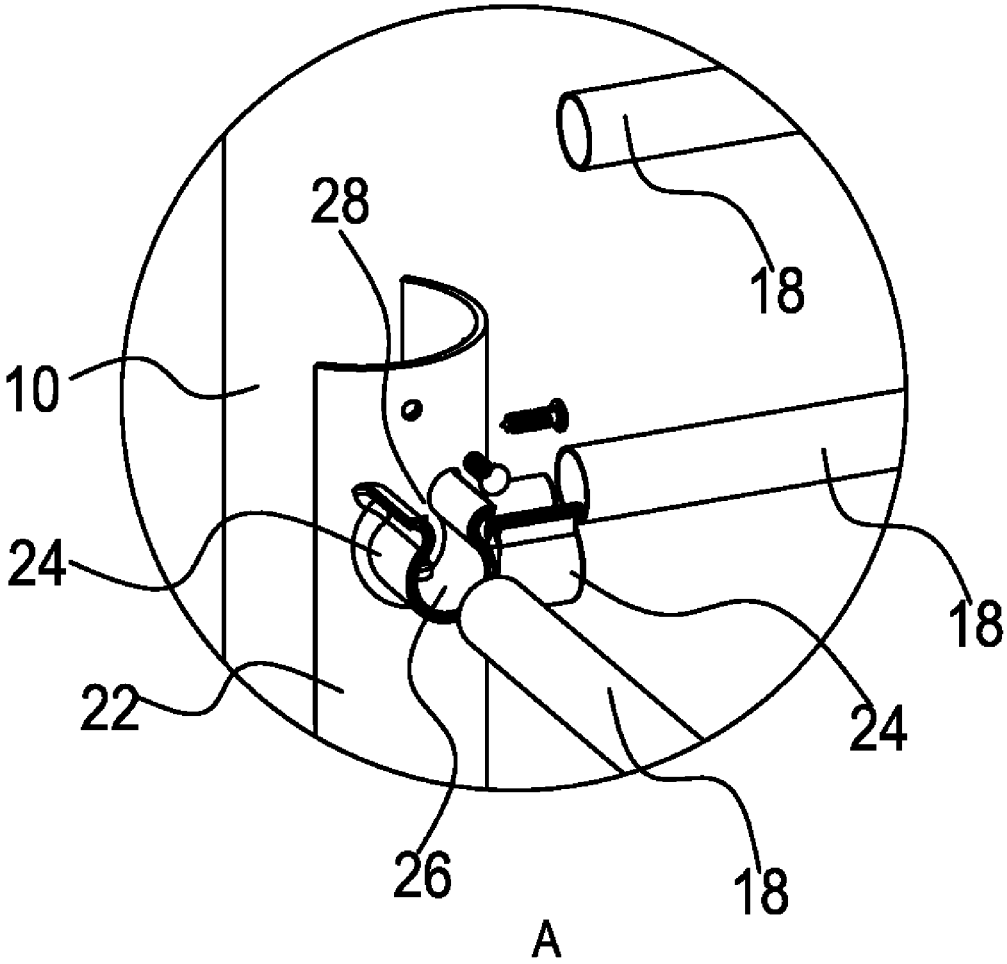
FIG. 3 is a partial enlarged view of the A in FIG. 2.

Referring to FIG. 3, it is a partial enlarged view of the A in FIG. 2, a supporting piece 22 fixed on the extending portion, the supporting piece 22 cooperated with the extending portion to form an upright pole. The supporting piece is provided with a clamping member 24, said clamping member 24 comprises a clamping groove 26 opened upwardly and an opening 28 disposed on the clamping groove 26 and connecting the clamping groove 26, the width of the opening is smaller than the inner-diameter of the clamping groove 26. The end portion of the guardrail 18 is inserted into the clamping groove 26 via the opening 28, thus the upright pole can be detachably mounted with the guardrail 18.

Referring to FIG. 1 and FIG. 2, the bunk bed further comprises coupling members 30 having several hooks 32 for detachably clamping several parallel guardrails 18 respectively.

According to requirement, each leg 10 has a middle-portion between the upper bed 14 and the lower bed 12. Several guardrails 18 parallel disposed between the front middle-portion and the rear middle-portion, the connecting structure between the end portion of the guardrail 18 and the middle-portion is the same as the connecting portion between the end portion of the guardrail 18 and the extending portion.

According to requirement, two fixation rods disposed in the front edge of the upper bed 14 (the fixation rods 34 are also upright pole in this embodiment), a plurality of position collars 36 are sleeved on the fixation 34 in sequence, herein the bottom of the upper position sleeve 36 is abut against the top of the lower position sleeve 36, each position sleeve 36 protruded out a plastic sleeve 38. The end of the guardrail 18 can detachably insert into the hole of the plastic sleeve 38 so as to detachably connect the fixation rod 34 with the guardrail 18.

Embodiment 2

Figure 4:
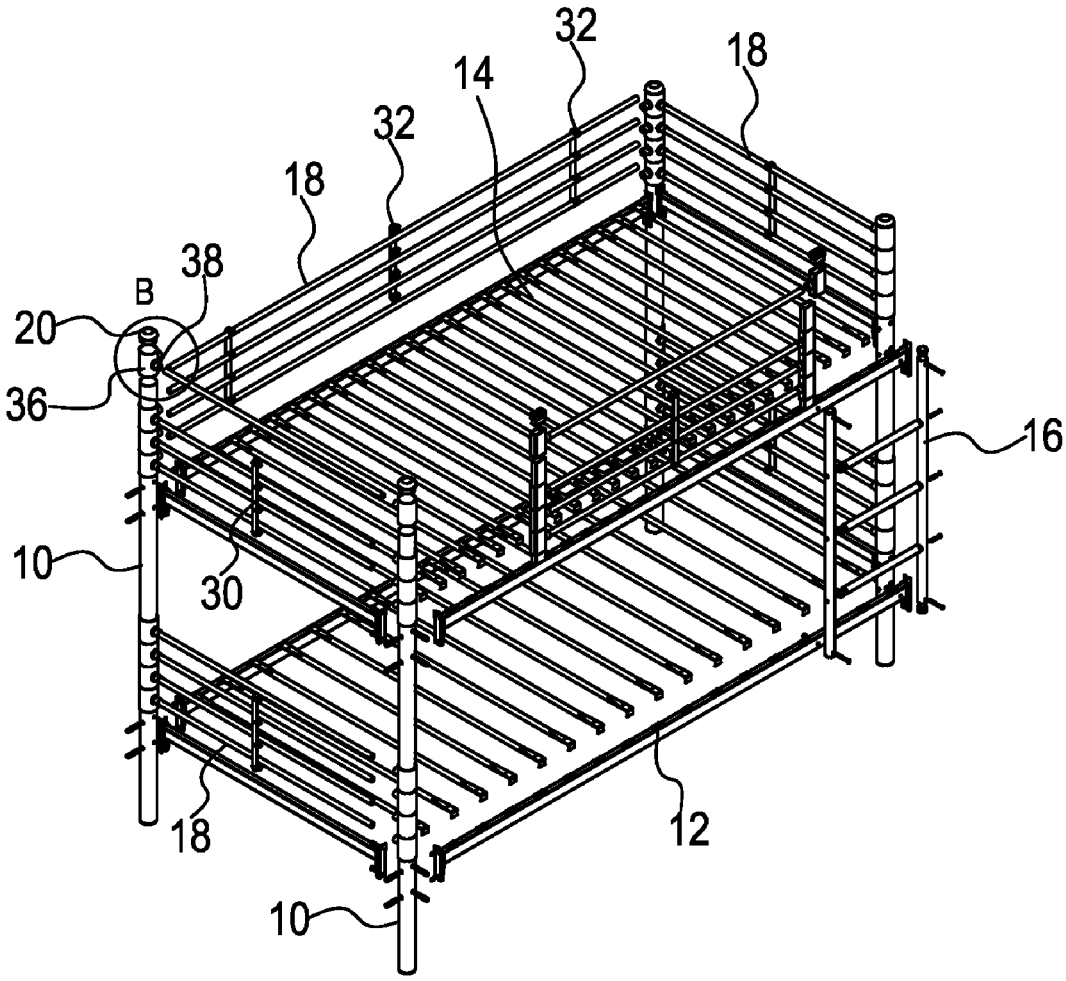
FIG. 4 is an exploded perspective view of the bunk bed of the present invention according to embodiment 2.
Figure 5:
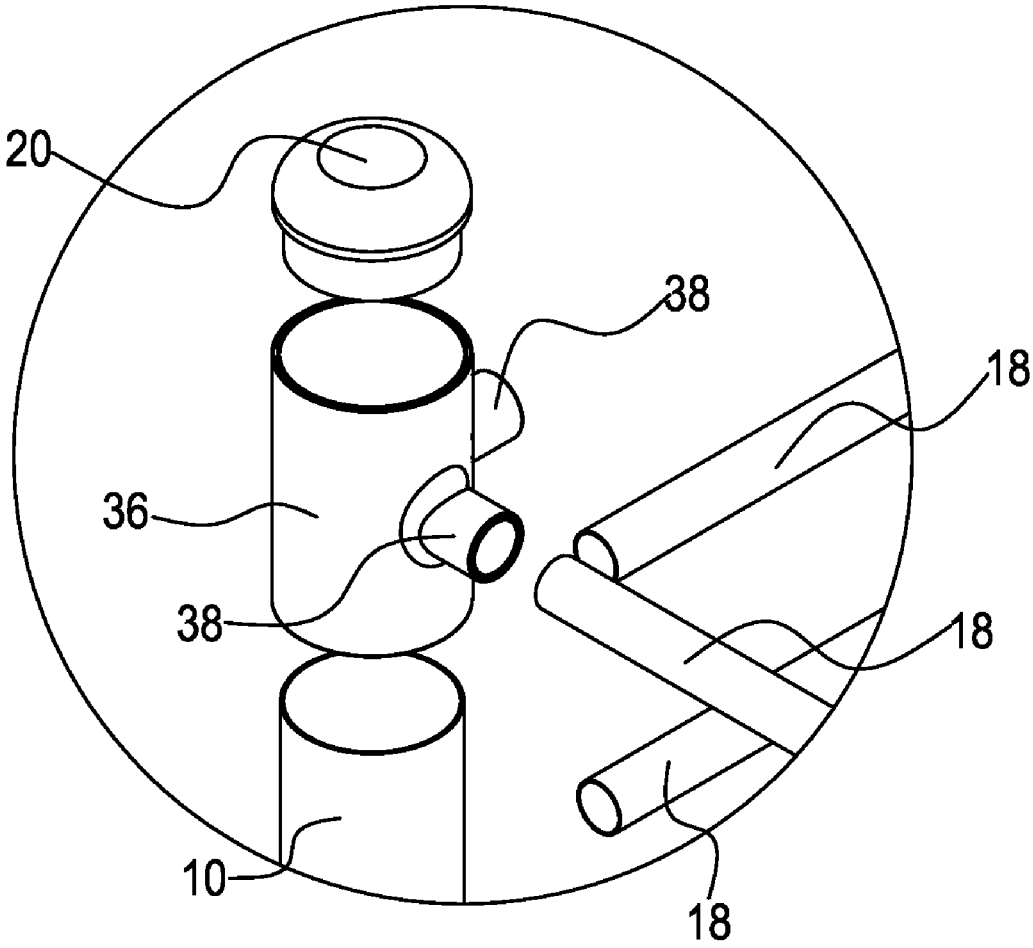
FIG. 5 is a partial enlarged view of B in FIG. 4

Referring to FIG. 4 and FIG. 5, they show the exploded perspective view and partial enlarged view of B of the bunk bed in this embodiment respectively. This embodiment is position-collar type, different to embodiment 1, the extending portion is sleeved by a plurality of position sleeves 36, herein the bottom of each upper position sleeve is abut against the top of the lower position sleeve 36, and each position sleeve 36 is protruded out a plastic sleeve 38. The end portion of the guardrail 18 is detachably inserted in the hole of the plastic sleeve 38, thus the guardrail 18 is detachably connected with the fixation rod 34.

Embodiment 3

Figure 6:
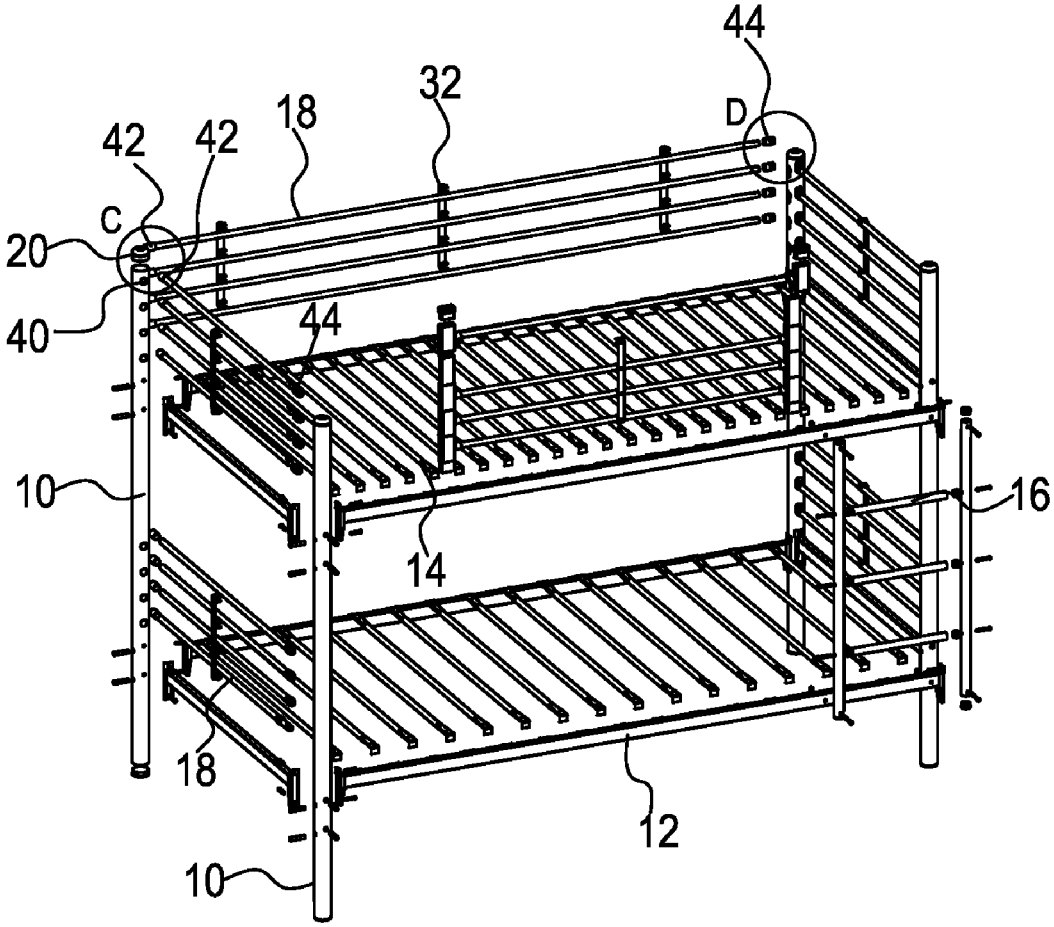
FIG. 6 is an exploded perspective view of the bunk bed of the present invention according to embodiment 3.
Figure 7:
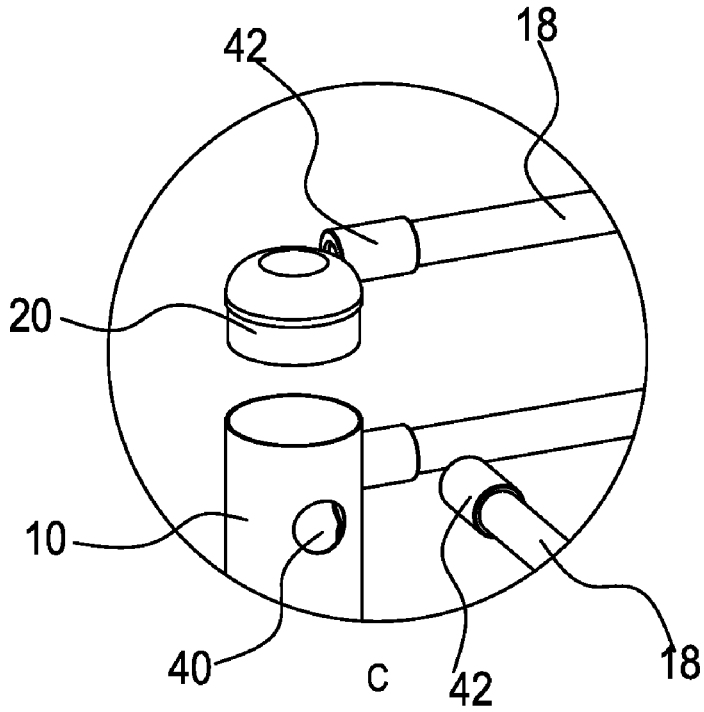
FIG. 7 is a partial enlarger view of C in FIG. 6
Figure 8:
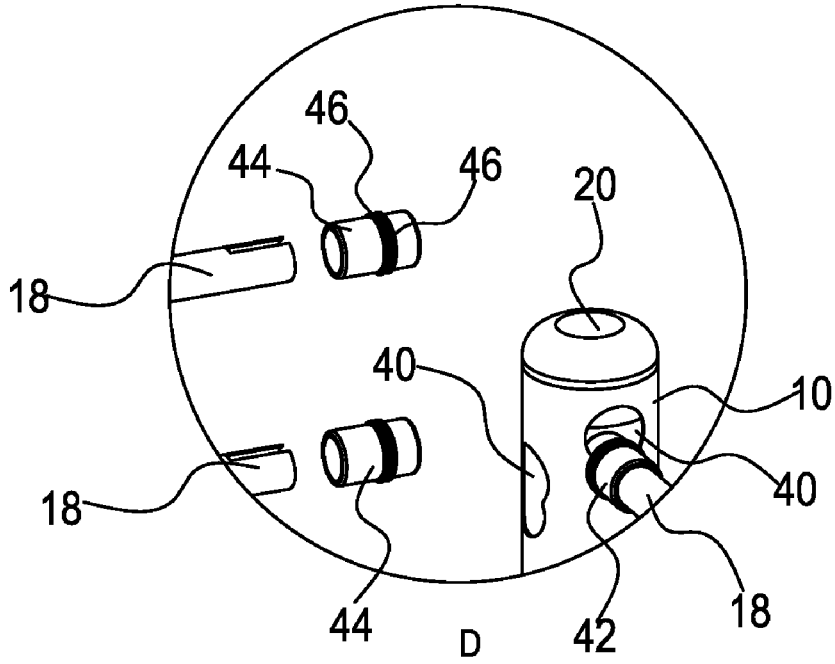
FIG. 8 is a partial enlarger view of D in FIG. 6.

Referring to FIG. 6, FIG. 7 and FIG. 8, they show the exploded perspective view, partial enlarged view of C and partial enlarged view of D of the bunk bed respectively. This embodiment is centrally-tapered hole type, the difference to embodiment 1 is as follows: the extending portion is provided with connecting holes 40 through the wall. The first end of the guardrail is provided with a plastic sleeve 42, the second end of the guardrail is provided with a second sleeve 44, the second plastic sleeve 44 is protruded out two protrusion ring 46, a groove matching with the thickness of the wall of the extending portion is formed between the two protrusion ring 46. The first plastic sleeve 42 is detachably inserted in the connecting hole 40 of the extending portion; the second connecting hole is a centrally-tapered hole, and the width of the upper portion of the hole is larger than the lower portion, and the width of the lower portion is smaller than the out diameter of the protrusion ring 46, the end of the second plastic sleeve 44 insert from the upper portion of the hole, then push to the lower portion of the hole to let the two protrusion ring 46 formed clamping connection.

Embodiment 4

Figure 9:
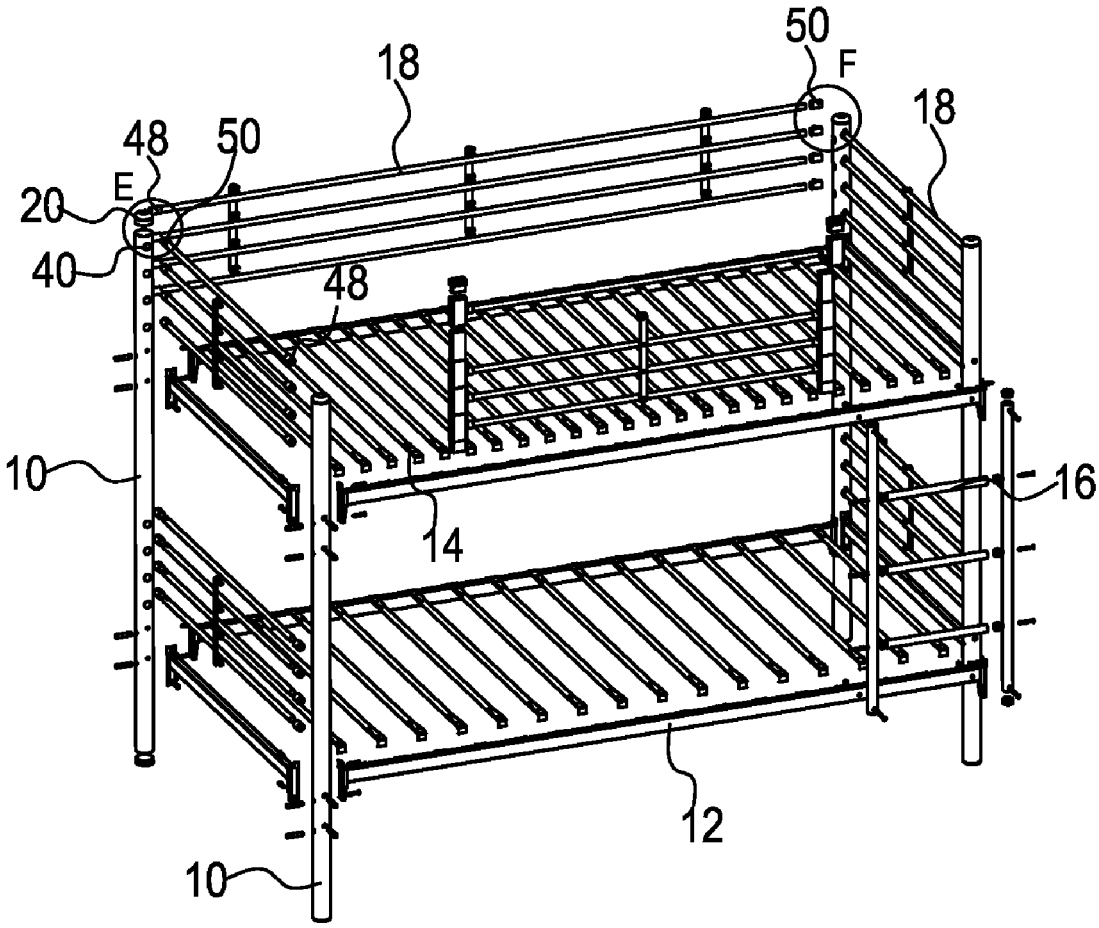
FIG. 9 is an exploded perspective view of the bunk bed of the present invention according to embodiment 4.
Figure 10:
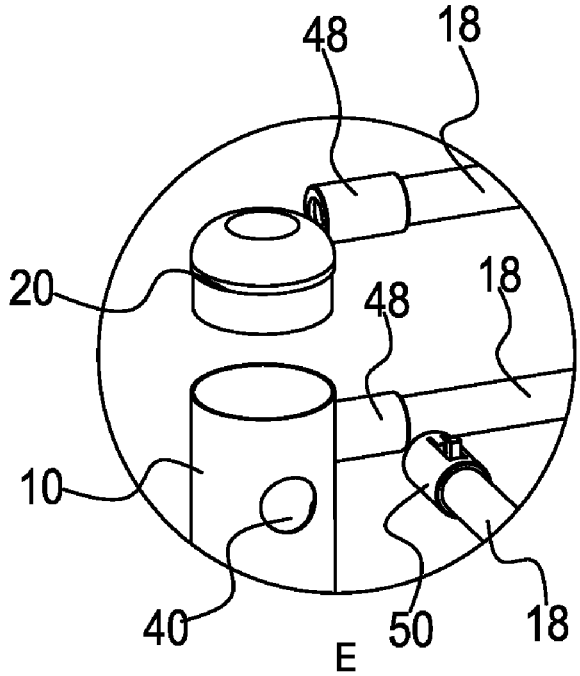
FIG. 10 is a partial enlarger view of E in FIG. 9.
Figure 11:
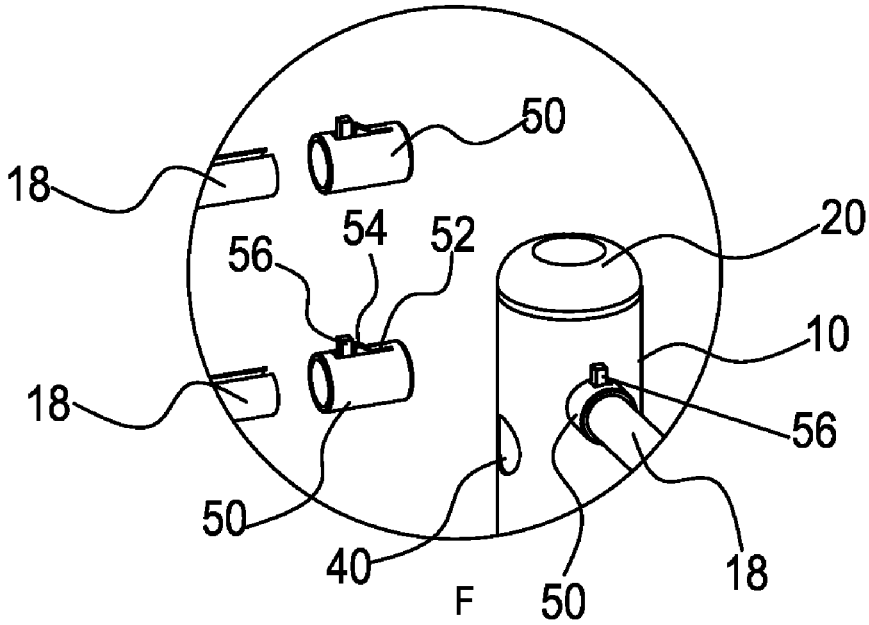
FIG. 11 is a partial enlarger view of F in FIG. 9.

Referring to FIG. 9, FIG. 10 and FIG. 11, they show the exploded perspective view, partial enlarged view of E and partial enlarged view of F of the bunk bed respectively. This embodiment is a button type, the difference to the embodiment 1 is as follows: the extending portion has connecting holes 40 through the wall. The first end of the guardrail 18 has a plastic sleeve 48, the second end of the guardrail has a second plastic sleeve 50, and the second plastic sleeve 50 has a hollow portion extending out the second end. The second plastic sleeve 50 has a flexible arm 52, which is protruded out two protrusions, the protrusion in the outside is a clamping block 54 and the protrusion in the inside is button block 56, a clamping groove match with the thickness of the wall of the extending portion is formed between the clamping block 54 and the button block 56. The first plastic sleeve 48 detachably insert in the connecting hole 40 of a extending portion; the second plastic sleeve 50 detachably insert in the connecting hole 40 of another extending portion, the clamping block 54 is inside the pipe of extending portion, and the button block 56 is outside the pipe of the extending portion, and the clamping groove sleeved the flange of the connecting hole 40.

Embodiment 5

Figure 12:
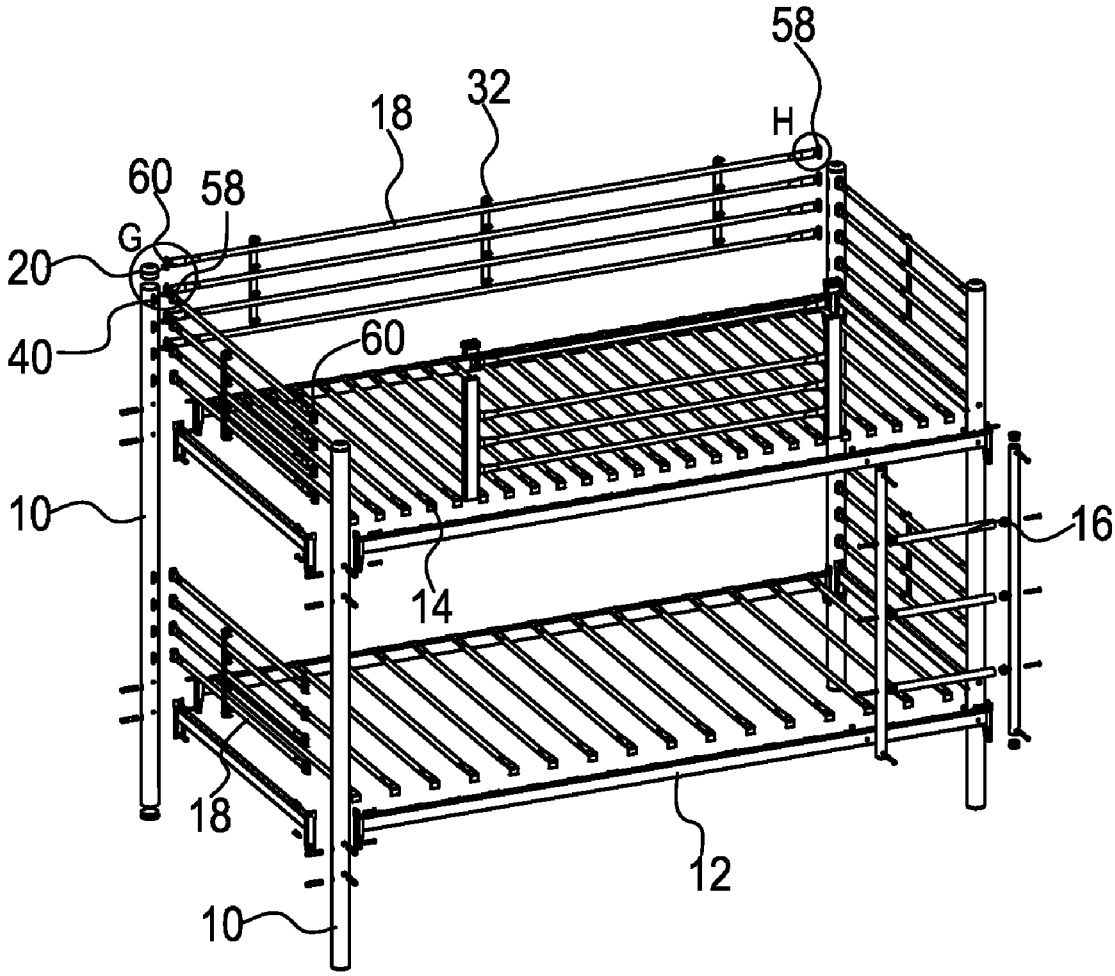
FIG. 12 is an exploded perspective view of the bunk bed of the present invention according to embodiment 5.
Figure 13:
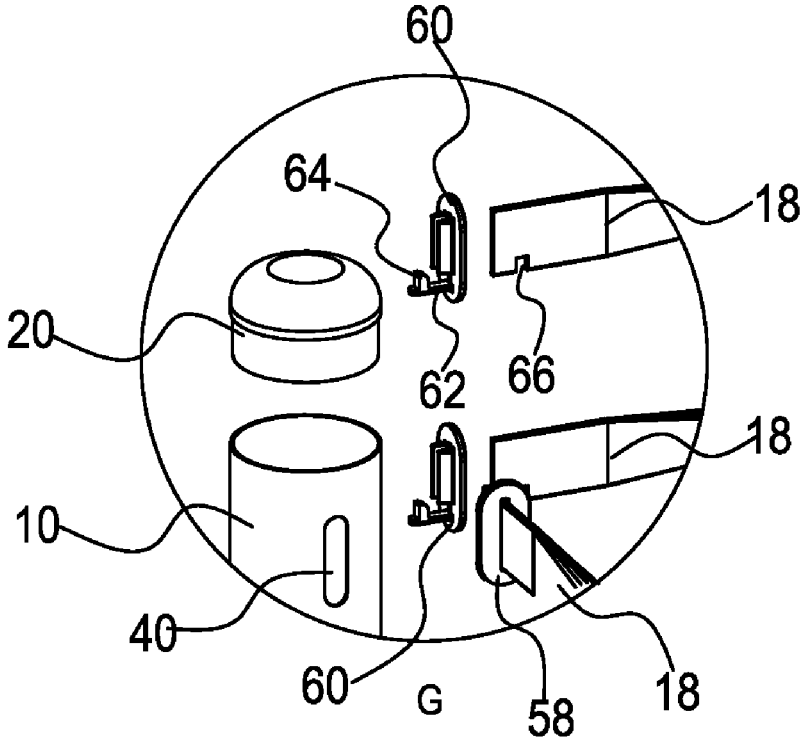
FIG. 13 is a partial enlarged view of C in FIG. 12.
Figure 14:
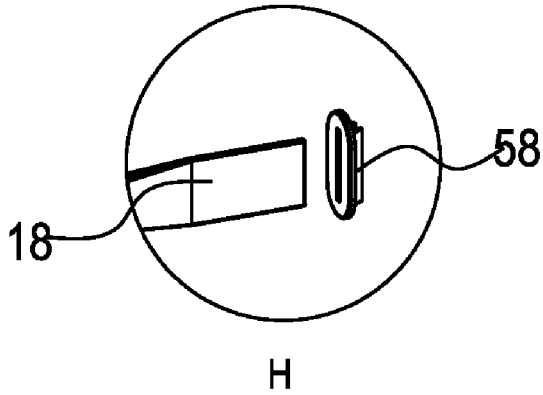
FIG. 14 is a partial enlarged view of H in FIG. 12.

Referring to FIG. 12, FIG. 13 and FIG. 14, they show the exploded perspective view, partial enlarged view of G and partial enlarged view of H of the bunk bed respectively. This embodiment is clamping type, the difference to the embodiment 1 is as follows: the first extending portion has flat connecting holes 40 through the wall, herein between the two cooperated extending portions: the connecting hole 40 of the first extending portion has a first plastic sleeve 58, the connecting hole 40 of the second extending portion has a second plastic sleeve 60. A flexible arm 62 disposed in the bottom of the second plastic sleeve 60, and a protrusion 64 disposed on the flexible arm 62; two pieces arranged in the two sides of the hole respectively. The two end of the guardrail 18 are flat, and a slot is disposed in the bottom of the second end. The first end of the guardrail 18 detachably insert in the first plastic sleeve 58, the second end of the guardrail 18 detachably insert in the second plastic sleeve 60, and the protrusion 64 insert in the slot 66.

Embodiment 6

Figure 15:
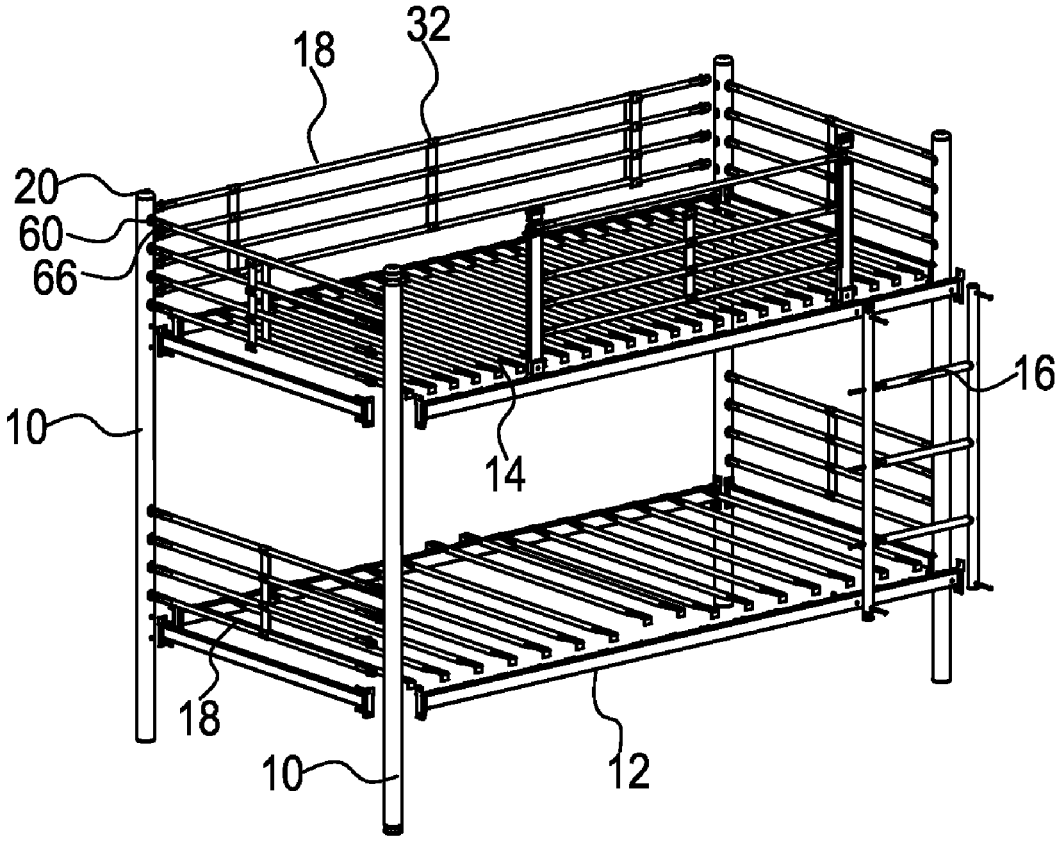
FIG. 15 is an exploded perspective view of the bunk bed of the present invention according to embodiment 6.

Referring to FIG. 15, it shows the exploded perspective view of the bunk bed in this embodiment. The difference to the embodiment 5 is as follows: the end of the guardrail is ellipse, the hole of the first sleeve 58 and the hole of the second sleeve 60 are ellipse accordingly; the end of the guardrail 18 is match to the hole of the first sleeve 58 and the hole of the second sleeve 60.

Embodiment 7

Figure 16:
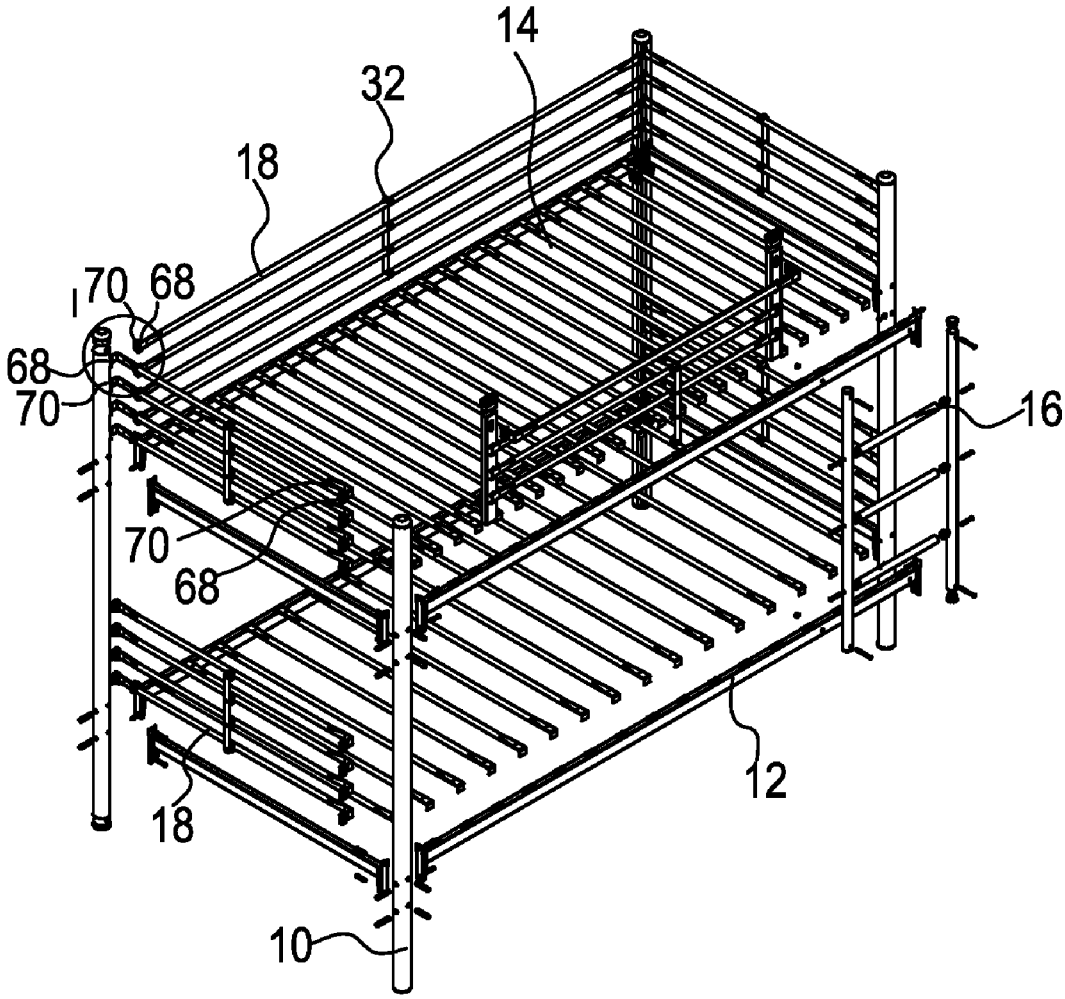
FIG. 16 is an exploded perspective view of the bunk bed of the present invention according to embodiment 7.
Figure 17:
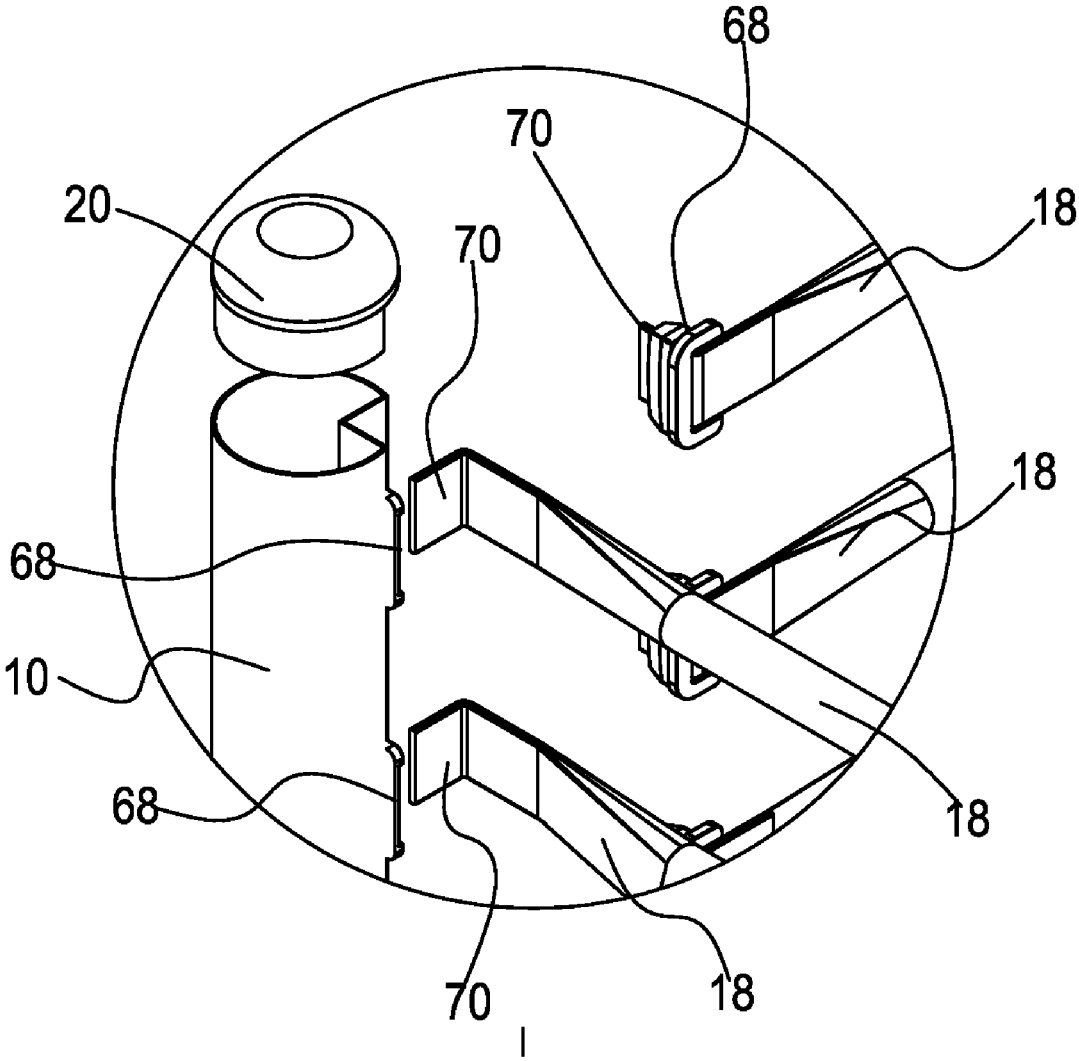
FIG. 17 is a partial enlarged view of I in FIG. 16.

Referring to FIG. 16 and FIG. 17, they show the exploded perspective view, partial enlarged view of I of the bunk bed respectively. The difference to the embodiment 1 is as follows: the inner side of the extending portion has connecting holes 40 through the wall, and a plastic sleeve 68 insert in the connecting hole 40; a clamping end is formed from the end of the guard 18 extended vertically, the clamping end 70 of the guardrail 18 insert in the sleeve 68 from outside to inside. Herein the extending portion in the rear must both connect the guardrail 18 in the and the guardrail in the, thus the transverse portion of the extending portion is configured to a arc frame with a of 270 degree.

Embodiment 8

Figure 18:
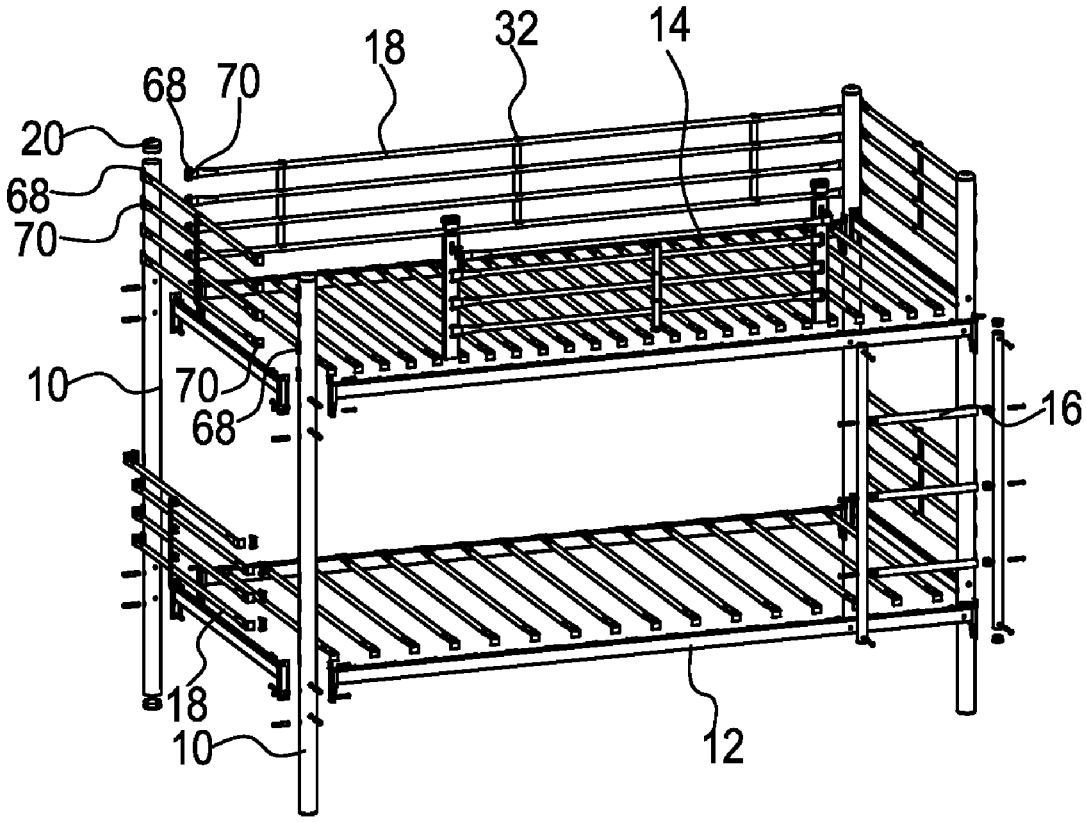
FIG. 18 is an exploded perspective view of the bunk bed of the present invention according to embodiment 8.
Figure 19:
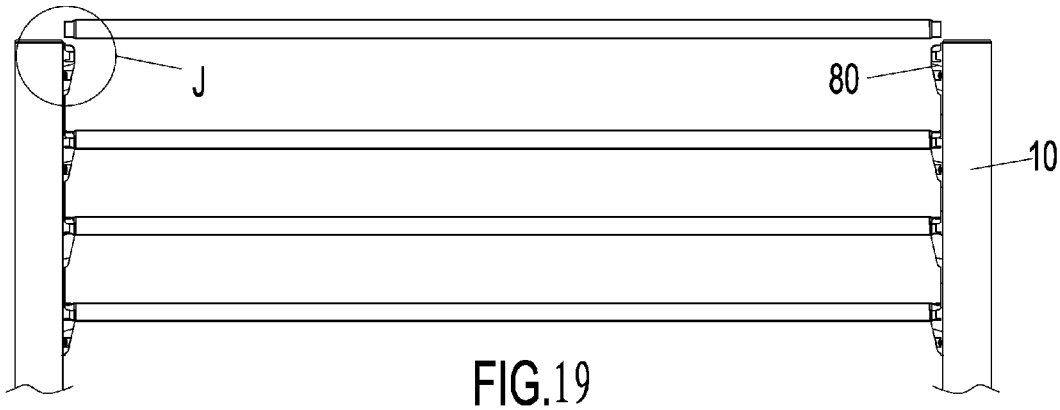
FIG. 19 is a sectional view of the connecting structure between the upright pole and the guardrail according to embodiment 9.
Figure 20:
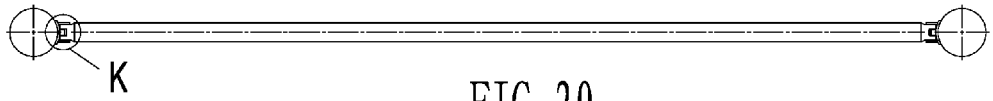
FIG. 20 is a top view of embodiment 9 in FIG. 19.

Referring to FIG. 18, it shows the exploded perspective view of the bunk bed in this embodiment. The difference to embodiment 7 is as follows: the outside of the extending portion has connecting hole 40 through the wall, clamping end 70 of the guardrail 18 detachably inset in the sleeve 68 from outside to inside.

Embodiment 9

Referring to FIG. 19 to FIG. 23, the connection between the guardrail 18 and the upright pole is by tongue-connection, the upper portion of the clamping member 80 has a pair of vertical lugs 81, a position platform is disposed below the lug 81, the distance between the two lugs is match to the out-diameter of the guardrail 18, a tongue 82 disposed between the two lugs 81, the size of the tongue 82 is match to the inner diameter of the front end of the guardrail 18, the front end of the guardrail 18 has a groove along the radial direction, and the width of the groove is a little wider than the width of the tongue 82. the clamping member 80 fixed to the upright pole via rivet.

Figure 21:
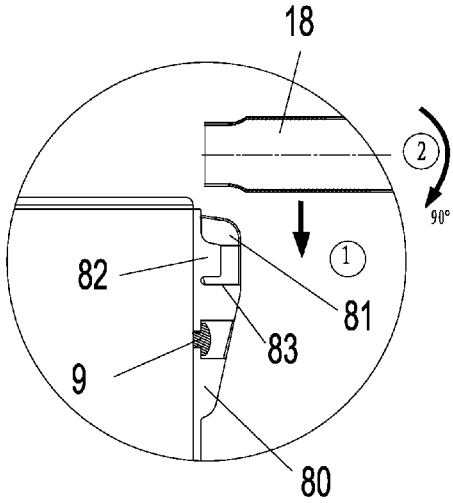
FIG. 21 is a partial enlarged view of J of FIG. 19 before assembly.
Figure 22:
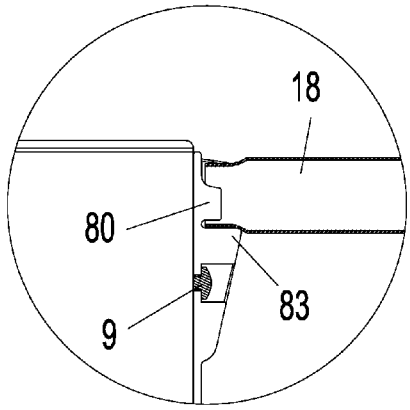
FIG. 22 is a partial enlarged view of J of FIG. 19 after assembly.
Figure 23:
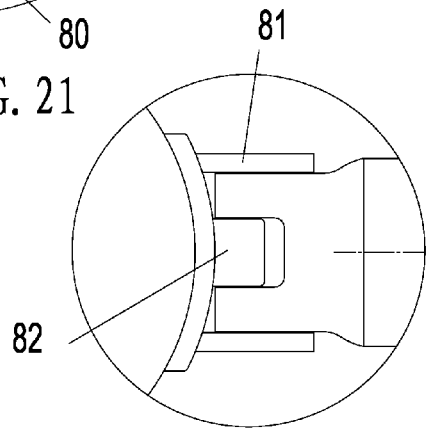
FIG. 23 is a partial enlarged view of K of FIG. 20.
Figure 24:
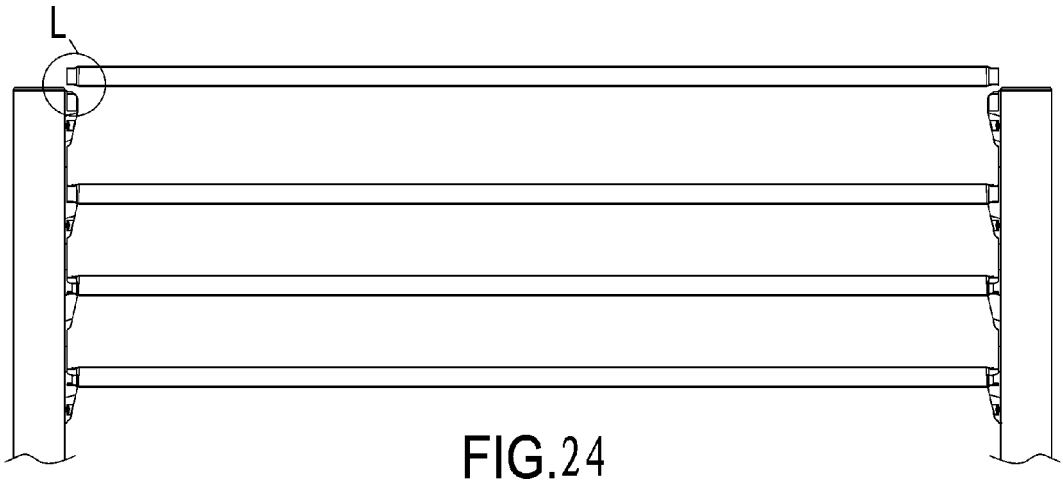
FIG. 24 is a sectional view of the connecting structure between the upright pole and the guardrail according to embodiment 10.
Figure 25:
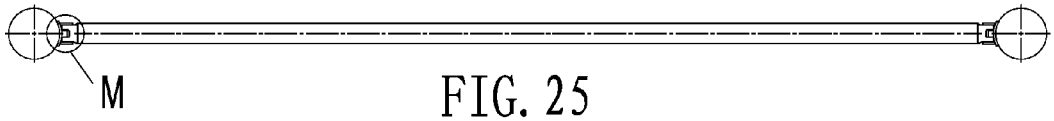
FIG. 25 is a top view of embodiment 10 in FIG. 24.

In assembly, as shown in FIG. 21 and FIG. 23, insert the front end of the guardrail 18 between the two lugs of the clamping 80 from top till to the position platform 83, the tongue 82 is in the groove 82; then turn the guardrail 90 degree to let the groove in a horizontal level, the tongue 82 positioned in the guardrail 18, as shown in FIG. 24.

Embodiment 10

Referring to FIG. 24 to FIG. 28, the connection between the guardrail 18 and the upright pole is by tongue-connection, the upper portion of the clamping member 80 has a pair of vertical lugs 81, a position platform is disposed below the lug 81, the distance between the two lugs is match to the out-diameter of the guardrail 18, a tongue 84 disposed between the two lugs 81, the distance between the bottom of the tongue 84 and the position platform is match to the out-diameter of the front end of the guardrail 18, the front end of the guardrail 18 has a groove along the radial direction, and the width of the groove is a little wider than the width of the tongue 84. the clamping member 80 fixed to the upright pole via rivet.

Figure 26:
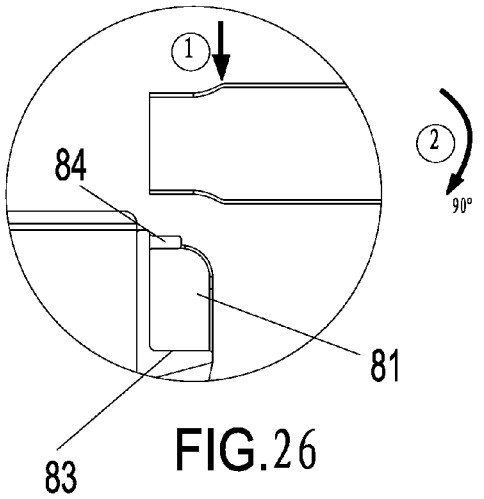
FIG. 26 is a partial enlarged view of L of FIG. 24 before assembly.
Figure 27:
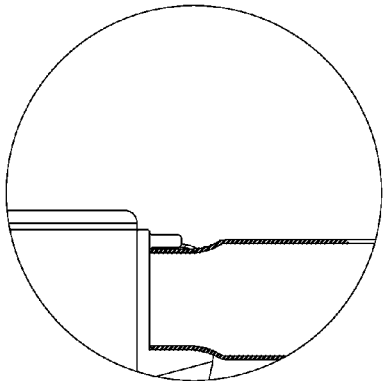
FIG. 27 is a partial enlarged view of L of FIG. 24 after assembly.
Figure 28:
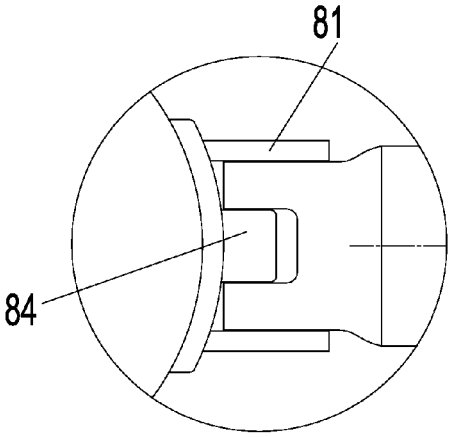
FIG. 28 is a partial enlarged view of M of FIG. 25.
Figure 29:
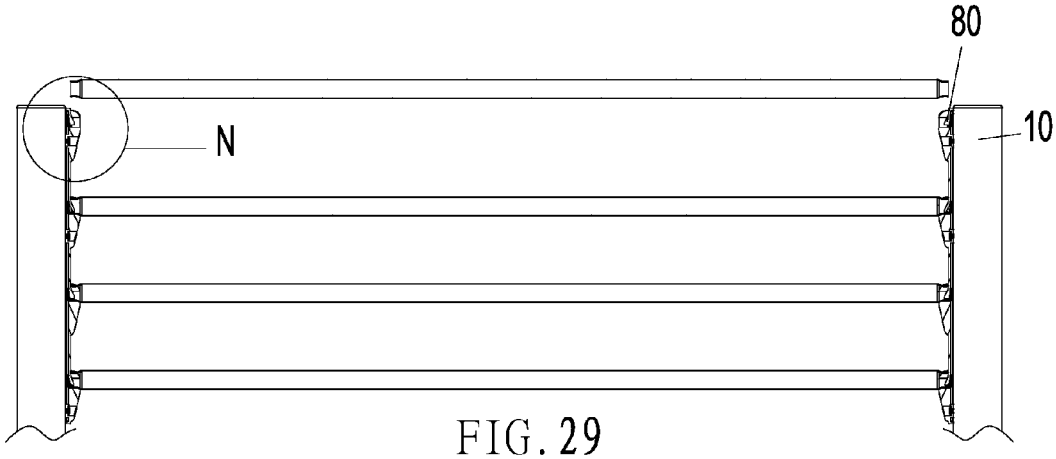
FIG. 29 is a sectional view of the connecting structure between the upright pole and the guardrail according to embodiment 11.
Figure 30:
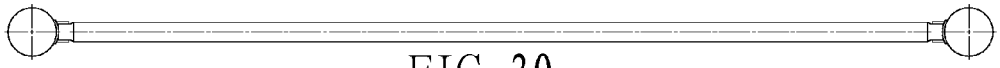
FIG. 30 is a top view of embodiment 11 in FIG. 29.

In assembly, as shown in FIG. 26 and FIG. 28, insert the front end of the guardrail 18 between the two lugs of the clamping 80 from top till to the position platform 83, the tongue 84 is in the groove 82; then turn the guardrail 90 degree to let the groove in a horizontal level, the tongue 84 positioned in the guardrail 18, as shown in FIG. 27.

Embodiment 11

Referring to FIG. 29 to FIG. 32, the connection between the guardrail 18 and the upright pole is by tongue-connection, the upper portion of the clamping member 80 has a pair of vertical lugs 81, a position platform 83 is disposed below the lug 81, the distance between the two lugs is match to the out-diameter of the guardrail 18, a tongue 85 disposed between the two lugs 81, the clamping member 80 fixed to the upright pole via rivet.

Figure 31:
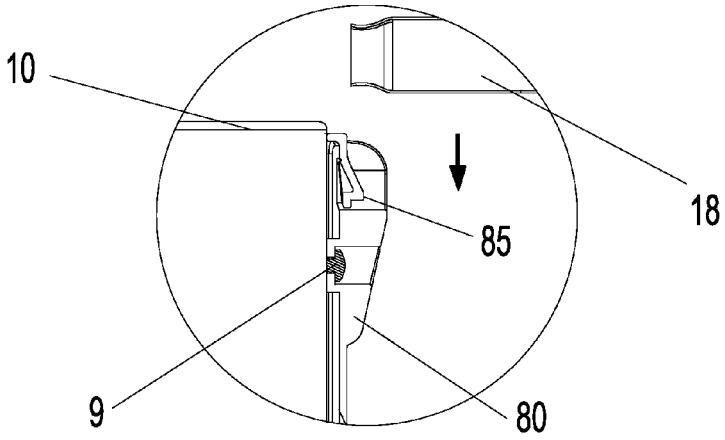
FIG. 31 is a partial enlarged view of N of FIG. 29 before assembly.
Figure 32:
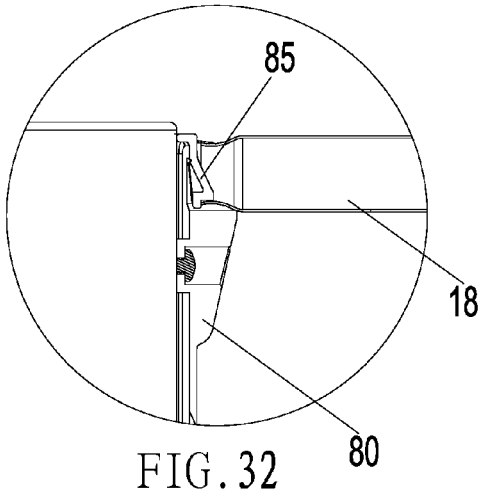
FIG. 32 is a partial enlarged view of N of FIG. 29 after assembly.

In assembly, as shown in FIG. 31, insert the front end of the guardrail 18 between the two lugs of the clamping 80 from top, the flexible tongue 85 recess, when the guardrail 18 reach to the position platform 83, the flexible tongue 85 released, the flexible 85 is positioned inside the guardrail 18 groove 82, as shown in FIG. 32.

INDUSTRIAL APPLICABILITY

The removable guardrail framework of the present invention connected between two upright poles of a bunk bed, the guardrail has two ends and the two ends are detachably connected with two upright poles. the present invention has the following advantages: because the end portion of the guardrail detachably connecting to the upright poles, thus they can be changed according to situation, for example, they disassembled in transport, carry and storage and assembled in use, thus facilitate the transport, carry and storage by the user.

A number of embodiments of the invention have been described. Nevertheless, it will be understood that various modifications may be made without departing from the spirit and scope of the invention. Accordingly, other embodiments are within the scope of the following claims.

What is claimed is:

1. A removable guardrail framework, comprising:

a guardrail having two ends, and being connectable between two upright posts of a bunk bed, the two ends being respectively detachably connected with the two upright posts; and a clamping member that is fixable to a respective upright post using a rivet, the clamping member including:

an upper portion having a pair of vertical lugs, the lugs being spaced apart from each other by a distance that matches an outer diameter of said guardrail, a position platform disposed below the lugs, and a tongue disposed between the lugs, wherein a connection between the guardrail and the respective upright post is by a tongue-connection.

2. The removable guardrail framework according to claim 1, wherein the tongue is a flexible tongue, and wherein a front end of the guardrail is insertable between the lugs of the clamping member from a top thereof, thereby causing the flexible tongue to recess, and when the guardrail reaches the position platform, the flexible tongue is released and is positioned inside a guardrail groove.

* * * * *